US005649621A

United States Patent [19]

Brody

[11] Patent Number: 5,649,621

[45] **Date of Patent: *Jul. 22, 1997**

[54] FOLDABLE DISPLAY CARD FOR BUTTERFLY-MOLDED ITEM

[75] Inventor: Harvey Brody, Costa Mesa, Calif.

[73] Assignee: Delshar Industries, Inc., Santa Ana, Calif.

[ * ] Notice: The term of this patent shall not extend beyond the expiration date of Pat. No. 5,509,532.

[21] Appl. No.: 593,668

[22] Filed: Jan. 29, 1996

Related U.S. Application Data

[63] Continuation-in-part of Ser. No. 378,623, Jan. 26, 1995, Pat. No. 5,509,532, which is a continuation-in-part of Ser. No. 253,369, Jun. 3, 1994, abandoned.

[51] Int. Cl.[6] ..... A45C 11/26

[52] U.S. Cl. ..... 206/349; 206/461; 206/464; 206/493; 206/806

[58] Field of Search ..... 206/461, 462, 206/470, 477, 478, 480, 481, 482, 485–487, 490, 493, 495, 349, 464, 586, 806

[56] References Cited

U.S. PATENT DOCUMENTS

| | | | |
|---|---|---|---|
| 1,602,440 | 10/1926 | Lowenthal . | |
| 3,026,639 | 3/1962 | Lille | 40/10 |
| 3,370,733 | 2/1968 | Giesler | 215/100 |
| 3,957,196 | 5/1976 | Kellerman | 229/14 |
| 4,558,783 | 12/1985 | Dangerfield et al. | 206/472 |
| 4,899,882 | 2/1990 | Benner | 206/470 |
| 5,176,257 | 1/1993 | Levy | 206/456 |
| 5,509,532 | 4/1996 | Brody | 206/349 |

*Primary Examiner*—David T. Fidei
*Attorney, Agent, or Firm*—Klein & Szekeres, LLP

[57] ABSTRACT

A display card for holding an item, wherein the item has an integral hinge joining a pair of molded item halves, each defining an interior surface, that are foldable along the hinge, wherein the card includes a bottom edge and an extended portion, contiguous with the bottom edge, configured for engaging the interior surface of one of the item halves when the item halves are folded together. In one embodiment, the integral hinge includes first and second hinge portions separated by a slot, and the extended portion includes a projection that is insertable through the slot. An aperture in the projection receives a post extending from the interior surface of one of the item halves. In other embodiments, the extended portion is insertable into a slot that is parallel to, or collinear with, the integral hinge, the extended portion including laterally-extending fingers that engage the interior of the item halves adjacent the ends of the slot. In another embodiment, the extended portion includes first and second apertured projections that extend between the item halves, each aperture receiving a post extending from the interior of one of the item halves.

32 Claims, 7 Drawing Sheets

FOLDABLE DISPLAY CARD FOR BUTTERFLY-MOLDED ITEM

CROSS-REFERENCE TO RELATED APPLICATIONS

This application is a continuation in part of application Ser. No. 08/378,623, filed Jan. 26, 1995 now U.S. Pat. No. 5,509,532; which is a continuation in part of application Ser. No. 08/253,369, filed Jun. 3, 1994, now abandoned.

BACKGROUND OF THE INVENTION

This invention relates to the field of devices for displaying consumer items and articles for such purposes as retail sales. More specifically, it relates to an improved display card for removably holding an item, so that the item can be displayed from a store rack or the like.

Display cards are well-known devices for displaying consumer items for sale in a store. One typical kind of display card comprises a flat piece of cardboard, having a surface on which information (such as the item's brand name or trademark, and the identity and location of its manufacturer and/or distributor) can be printed. Means are provided, either integrally with the card, or separately (e.g., staples, elastic bands) for removably attaching the item to the bottom of the card. One or more apertures may typically be provided near the top of the card to accommodate a rod extending laterally from the rod-type of display rack.

A disadvantage of such prior art display cards is the amount of space they take up when they are shipped or stored with the items attached. Thus, a shipping or storage container must have an interior capacity sufficient not only for the actual items, but also for the additional space taken up by the display cards. This wasteful and inefficient use of space increases shipping and storage costs.

One approach to solving this problem is simply to reduce the size of the display cards, but this obviously impairs their primary function of displaying the goods so as to be attractive to buyers.

Another disadvantage of prior art display cards is that they are not self-attachable to the item to be displayed on the card, thereby requiring the additional cost and inconvenience of such attachment means or structure as staples, elastic bands, or adhesively-attached clear plastic bubbles.

There has thus been a long-felt, but as yet unsatisfied need for a display card that can occupy little space in shipping or storage, without compromising its primary purpose of providing an attractive and informative display. Additionally, there has been a need for such a space-saving display card that is also self-attachable to the item to be displayed.

SUMMARY OF THE INVENTION

Broadly, the present invention is a display card that (a) converts from a folded configuration, for shipping and storage with an item attached to it, to an unfolded configuration, for displaying the item attached to it; and (b) is self-attachable to the item to be displayed.

More specifically, the present invention is an improved display card for holding an item for display, of the type including a flat surface of sufficient size for the printing thereon of the desired textual, pictorial, and/or graphic information pertaining to the item, the surface defining a top edge and a bottom edge; first means for removably attaching the item near the bottom edge; and second means near the top edge for removably holding the card on a typical display rack; wherein the improvement comprises hinge means, near the bottom edge, for allowing the card to be selectively folded into the folded configuration, in which the card overlies the item for shipping and storage, and for allowing the card to be selectively restored to the unfolded configuration for display.

The hinge means comprises first and second substantially parallel linear creases in the card proximate and parallel to the bottom edge, whereby the card is foldable along the first crease to an intermediate position that is substantially perpendicular to the plane defined by the card in the unfolded configuration, and then foldable along the second crease to the folded configuration, wherein the card overlies the item in a position that is substantially parallel to the plane defined by the card in its unfolded configuration.

The specific embodiments disclosed herein are configured for self-attachment to a molded plastic item manufactured in a "butterfly" configuration, wherein the item includes two halves joined at an integral "living" hinge. Accordingly, the specific embodiments of the invention also include attachment means, integral with the card, for self-attachment of the card to the item by being captured between the item halves at the integral hinge.

In one embodiment, the attachment means comprises a shallow, substantially trapezoidal notch in the bottom edge of the card, the notch defining a pair of opposed, inwardly-pointed fingers. The hinged edge of the item fits in the notch, while the fingers are captured between the item halves, just under the integral hinge, when the item halves are folded together with the fingers between them. Preferably, one of the fingers is fixed, while the other is foldable away from the notch to facilitate the attachment of the item to card. Specifically, while the item is unfolded, and while the foldable finger is folded away from the notch, the fixed finger is inserted under the integral hinge of the item, and the hinged edge of the item is seated in the notch. The foldable finger is then unfolded to extend under the integral hinge. Finally, the item halves are folded together, capturing both fingers between them.

A second embodiment is adapted for use with items in which the integral hinge includes front and rear portions, separated by a gap. In this second embodiment, the attachment means comprises an apertured tab extending downwardly from the bottom edge of the card, with the first crease being along the juncture between the tab and the bottom edge of the card. The tab extends through the gap in the hinge, and the aperture in the tab receives a post attached to one of the item halves, with the post, in turn, being received in a socket in the other item half when the two item halves are folded together.

A third embodiment is likewise adapted for use with items with a "split hinge", i.e., a hinge with two portions separated by a gap. In this third embodiment, the attachment means comprises a shallow, substantially trapezoidal projection along the bottom edge of the card, with the first crease being along the juncture between the trapezoidal projection and the bottom edge of the card. The opposite sides of the trapezoidal projection define a pair of opposed, outwardly-pointed fingers, one of which is fixed, and the other of which is preferably foldable back over the projection. When the item is unfolded, and while the foldable finger is folded over the projection, the fixed finger is inserted under one portion of the integral hinge of the item, and the projection is inserted into the gap between the hinge portions. The foldable finger is then unfolded to extend under the other portion of the integral hinge. Finally, the item halves are folded together, capturing the projection between them.

In a variation of this third embodiment, the projection can be inserted into a special slot in the side of one of the item halves, with the foldable finger being similarly employed to facilitate the insertion. In this side-mounted variation, the hinge means of the card further comprises a third crease, parallel to and spaced upwardly from, the second crease. Upon insertion of the projection into the side slot, the card lies substantially perpendicular to the side of the item. The card is then folded 90° along the first crease to bring it substantially parallel to the side of the item. Then the card is folded 90° along the second crease, and finally it is folded 90° along the third crease to bring the card into its folded configuration, wherein the card overlies the item.

In a fourth embodiment, the card has a linear bottom edge, and the attachment means comprises a pair of substantially triangular fingers projecting outwardly from each lateral edge of the card adjacent the bottom edge. One or both of the fingers may be foldable inwardly toward the opposite lateral edge, and the hinge means may comprise either two or three parallel creases, depending upon whether the card is to be inserted into a slot in the top surface (two creases) or the side surface (three creases) of the item.

In a fifth embodiment, the attachment means comprises front and rear tabs extending downwardly from the bottom edge of the card, adjacent each of the lateral edges thereof. One or more apertures are provided in each of the tabs. The first crease lies along the juncture between each of the tabs and the bottom edge of the card. The hinged edge of the item fits between the tabs, while the apertures receive corresponding posts provided on one of the item halves. Each of the posts, in turn, is received in a corresponding socket formed in the other item half when the item halves are folded together with the tabs between them, on either side of the integral hinge.

The improved display card of the present invention offers the advantage of significant space savings, as compared with conventional display cards, when folded into its folded configuration for shipping or storage, yet it does so without sacrificing display area when unfolded. Indeed, when the card is in the folded configuration, the total space occupied by the item and the card together is only slightly greater than the amount of space occupied by the item alone. Thus, the items, with the cards attached, can easily be stacked in a container in a "dense pack" configuration for optimum usage of storage space. Indeed, the same size container can usually be used for the items with the cards attached as would be used for the same number of items without the cards attached.

In addition, the display card in accordance with the present invention is readily and easily self-attachable to "butterfly" molded items, without the expense and inconvenience of separate attachment means.

Furthermore, the improved display card of the present invention is easily and inexpensively made, requiring no additional components as compared to conventional display cards, and requiring a minimum of additional manufacturing steps.

These and other advantages of the present invention will be more readily appreciated from the detailed description that follows.

DETAILED DESCRIPTION OF THE INVENTION

Figure 1:
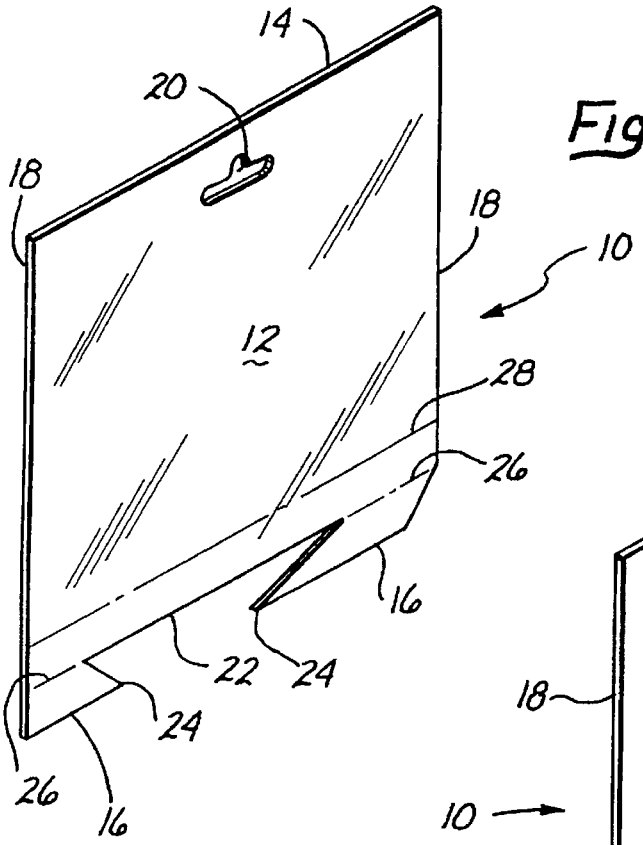
FIG. 1 is a perspective view of an improved display card, in accordance with a first embodiment of the present invention.

Referring first to FIG. 1, a foldable display card 10, in accordance with a first embodiment of the present invention, is shown. The card 10 comprises a flat piece of cardboard, having a front surface 12 defined between a top edge 14, a bottom edge 16, and a pair of opposed side edges 18. The front surface 12 has an area sufficient for the printing thereon of any desired textual, pictorial, and/or graphic information (not shown), as is the practice with conventional display cards. Alternatively, an adhesive label (not shown), printed with such information, may be applied to the front surface 12. The configuration of the card 10 shown in the drawings is substantially rectangular, but this configuration is exemplary only. It may be any arbitrary shape, except for the configuration of the bottom edge 16 (as will be explained below), and thus the terms "top edge" and "side edge" are employed merely for orientation purposes and to define the front surface 12 as being of finite dimensions.

An aperture 20 is advantageously provided near the top edge 14. The aperture 20 is configured to receive the lateral holding element (not shown) extending from a display rack (not shown) of conventional design, whether the holding element is configured as a single or double rod. The aperture 20 may be omitted if the card 10 is to be held on a clip-type rack (not shown).

The bottom edge 16 is interrupted by a relatively shallow trapezoidal notch 22, so as to define a pair of opposed, inwardly-pointed attachment fingers 24, which are thus integral with the body of the card 10, and contiguous with the bottom edge 16. Viewed another way, each of the fingers 24 defines both a portion of the bottom edge 16 and one of the non-parallel sides of the trapezoidal notch 22. The purpose of the attachment fingers 24 will be described below.

A first horizontal linear crease 26 is formed in the card proximate and substantially parallel to the bottom edge 16, and preferably contiguous with the top edge of the notch 22, so as to be interrupted by the notch 22, thereby defining the upper limit of each of the fingers 24. (Each of the fingers 24 is thus defined between a portion of the bottom edge 16 and a portion of the first linear crease 26.) A short distance upwardly from the first linear crease 26, and substantially parallel thereto, a second horizontal linear crease 28 is formed in the card 10. Together, the first linear crease 26 and the second linear crease 28 form hinge means that allow the card 10 to be folded and unfolded, as will be described below.

Figure 2:
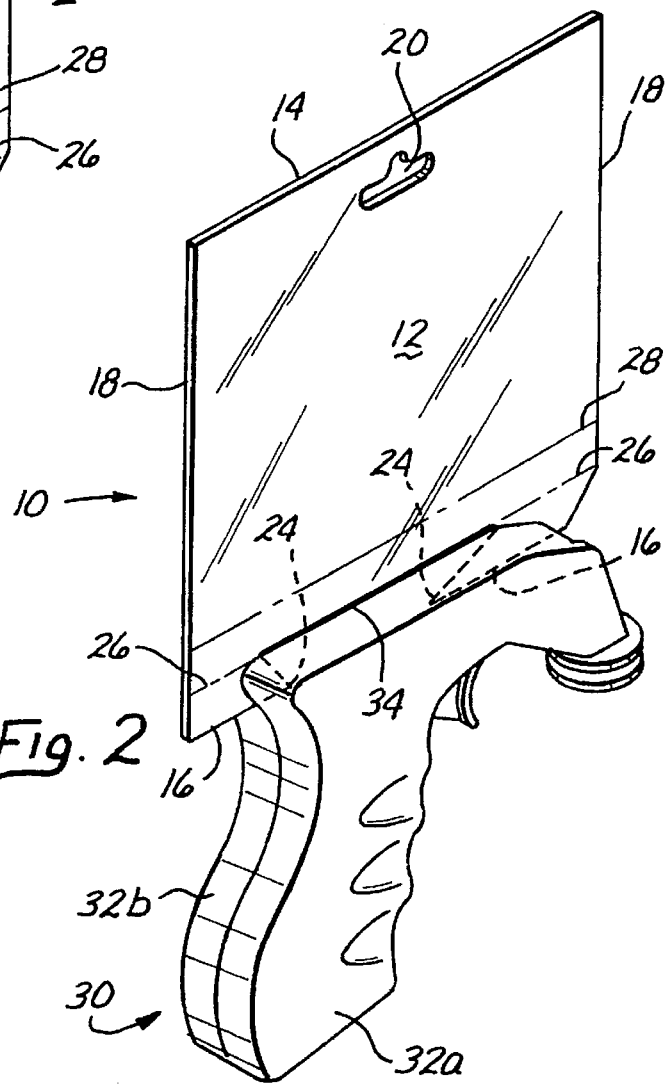
FIG. 2 is a view similar to that of FIG. 1, but showing the card attached to an item for display.
Figure 3:
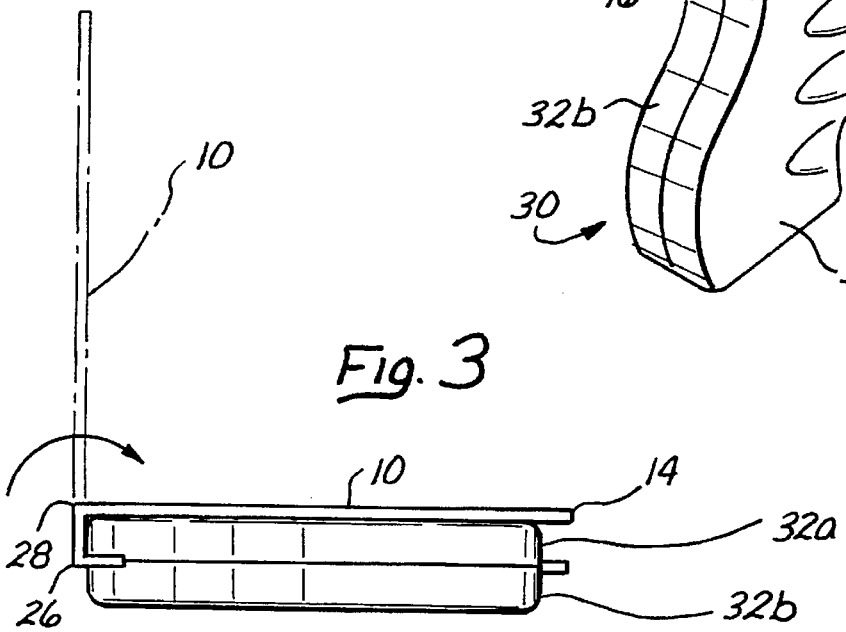
FIG. 3 is a side elevational view, taken from the left side of FIG. 2, showing the steps in the folding of the card from its unfolded configuration to its folded configuration.
Figure 5:
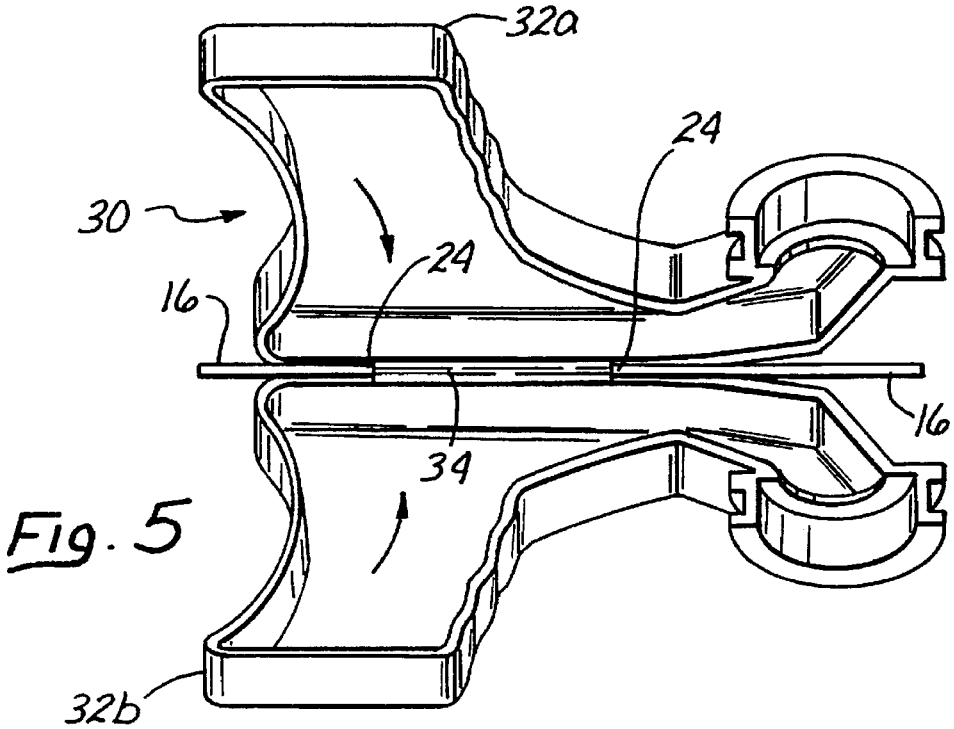
FIG. 5 is a perspective view, looking upwardly toward the bottom of the card, showing the attachment of the card to a "butterfly" molded item.

As shown in FIGS. 2, 3, and 5, the card 10 can be attached to a consumer item 30, so that the item can be displayed from a conventional display rack (not shown). The item 30 may be virtually any type of consumer item that can be conveniently packaged for display on such a rack, the item illustrated in the drawings being exemplary only. In the illustrated example (as best shown in FIG. 5), the item 30 is a plastic item, molded in a "butterfly" configuration, so that it is formed in two halves 32*a*, 32*b*, joined by an integral "living" hinge 34, along which the halves 32*a*, 32*b* are folded.

An item of the "butterfly" molded type is very well-suited for attachment to the card 10, since the inwardly-pointed fingers 24 function as attachment means that can be captured between the halves 32*a*, 32*b*, just under the integral hinge 34, when the item halves 32*a*, 32*b* are folded together with the fingers 24 between them. The upper portion of the item 30 thereby fits in the notch 22 in the bottom edge 16 of the card 10. The attachment fingers 24 thus allow the item 30 to be securely attached to the card 10 for display, yet they allow the item 30 to be easily removed from the card 10 by the purchaser. Furthermore, the attachment fingers 24, being integral with the card itself, require no additional attachment means or devices (e.g., staples, elastic bands, or adhesively-attached clear plastic bubbles), thereby simplifying and economizing the packaging of the item.

Items other than those with a living hinge 34 can be similarly attached to the card 10 by the attachment fingers 24, as long as there are portions of the item that can be engaged by the fingers 24.

FIG. 3 shows the steps in the folding of the card 10 through the use of the hinge means (the creases 26, 28). First, as shown in the dotted outline, the card 10 is folded along the first linear crease 26 to bring the card to an intermediate position that is substantially perpendicular to the plane it defines in its unfolded configuration (FIGS. 1 and 2). Then, as shown in the solid outline, the card 10 is folded along the second linear crease 28 to its folded configuration, wherein a substantial portion of the flat surface 12 of the card 10 overlies the item 30 in a position that is substantially parallel to the plane defined by the card 10 in its unfolded configuration. From FIG. 3, it can also be seen that the distance between the first linear crease 26 and the second linear crease 28 should be approximately equal to, or slightly greater than, the thickness of the adjacently underlying item half 32*a*. (Of course, the card 10 can be made to fold in the opposite direction so as to overlie the other item half 32*b*.)

Figure 4:
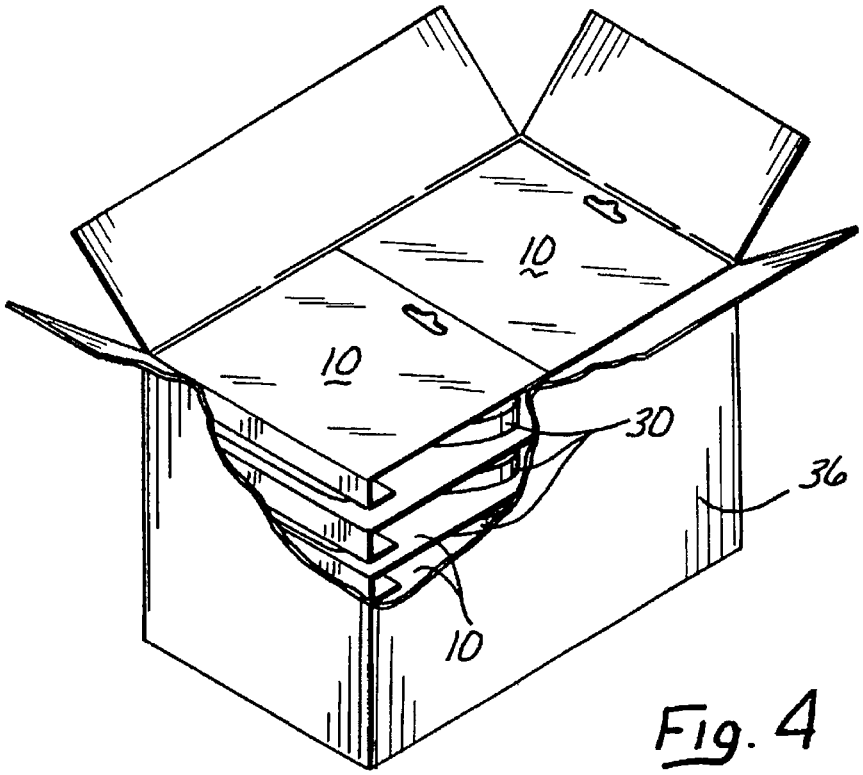
FIG. 4 is a perspective view, partially broken away, showing a plurality of display cards with items attached, as packed in a box with the display cards in the folded configuration.

FIG. 3 also shows that, with the card 10 folded flat against the item 30, the card 10 and the item 30 together occupy only slightly more space than would the item alone. This space-saving feature allows a much larger number of items to be packed in a given volume than if the cards 10 could not be folded. This is illustrated in FIG. 4, in which a container or box 36 is shown containing a number of items 30 with attached display cards 10. The cards 10 are in the their folded configurations, allowing the item/card assemblies to be closely stacked together in the box 36, in a so-called "dense pack" configuration, for optimum usage of the space within the box 36. Indeed, the same size container or box 36 can usually be used for the items with the cards attached as would be used for the same number of items without the cards attached.

Figure 6:
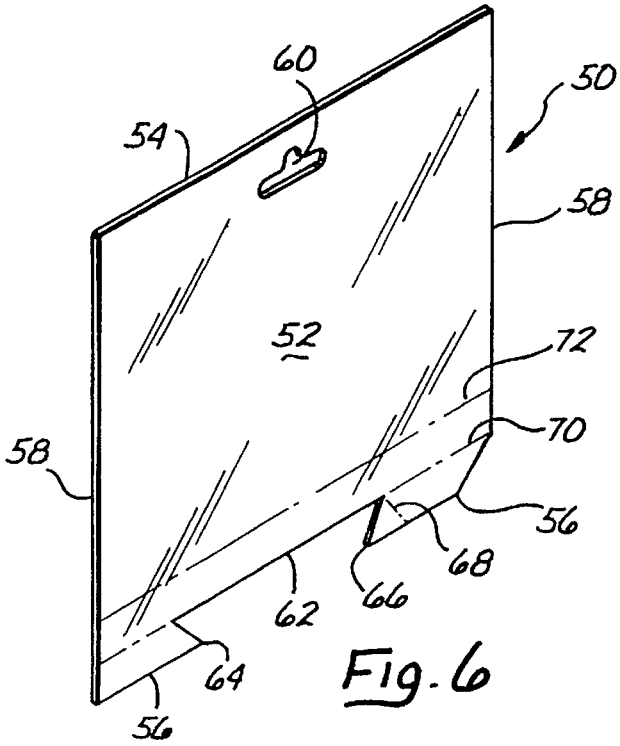
FIG. 6 is a perspective view of a display card in accordance with a preferred modification of the first embodiment of the invention.
Figure 7:
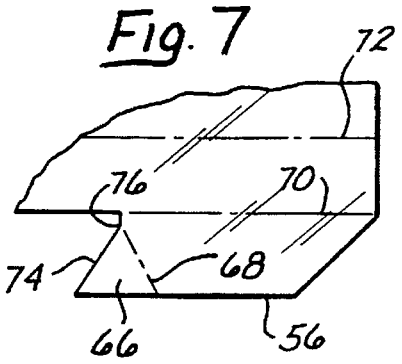
FIG. 7 is a detailed elevational view of the foldable finger of the modified first embodiment of FIG. 6, showing the finger in its unfolded position.
Figure 8:
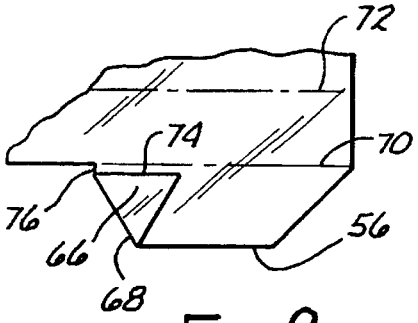
FIG. 8 is a detailed elevational view of the foldable finger of the modified first embodiment of FIG. 6, showing the finger in its folded position.

FIGS. 6, 7, and 8 illustrate a foldable display card 50, in accordance with an improved or preferred modification of the first embodiment of the present invention.

The improved display card 50 comprises a flat piece of cardboard, having a front surface 52 defined between a top edge 54, a bottom edge 56, and a pair of opposed side edges 58. An aperture 60 may be provided near the top edge, for the purposes previously described. The bottom edge 56 is interrupted by a relatively shallow trapezoidal notch 62, so as to define first and second opposed, inwardly-pointed attachment fingers 64, 66, respectively, which are thus integral with the body of the card 50, and contiguous with the bottom edge 56. Each of the fingers 64, 66 thus defines both a portion of the bottom edge 56 and one of the non-parallel sides of the trapezoidal notch 62. The first finger 64 is fixed, while the second finger 66 is foldable away from the notch 62 along an angled fold line or crease 68, as will be described in more detail below.

A first horizontal linear crease 70 is formed in the card proximate and substantially parallel to the bottom edge 56, and preferably contiguous with the top edge of the notch 62, so as to be interrupted by the notch 62, thereby defining the upper limit of each of the fingers 64, 66. (Each of the fingers 64, 66 is thus defined between a portion of the bottom edge 56 and a portion of the first linear crease 70.) A short distance upwardly from the first linear crease 70, and substantially parallel thereto, a second horizontal linear crease 72 is formed in the card 50. Together, the first linear crease 70 and the second linear crease 72 form hinge means that allow the card 50 to be folded and unfolded, as described above.

The foldable finger 66 is movable between an extended position (FIG. 7), in which it is directed toward the notch 62 and the fixed finger 64; and a folded position (FIG. 8), in which its directed away from the notch 62. As best shown in FIGS. 7 and 8, the foldable finger 66 includes an angled edge 74 that defines one of the non-parallel sides of the trapezoidal notch 62. The upper end point of the angled edge 74 is spaced from the first linear crease 70 by a short vertical edge 76. The angled crease 68, having an upper end point that is coincident with the upper end point of the angled edge 74, is oriented at an angle that allows the angled edge 74 of the foldable finger 66, when the foldable finger 66 is folded away from the notch 62, to be oriented substantially parallel to the bottom edge 56 and the first linear crease 70, and to be spaced from the first linear crease 70 by a distance that is substantially equal to the length of the short vertical edge 76.

Figure 9:
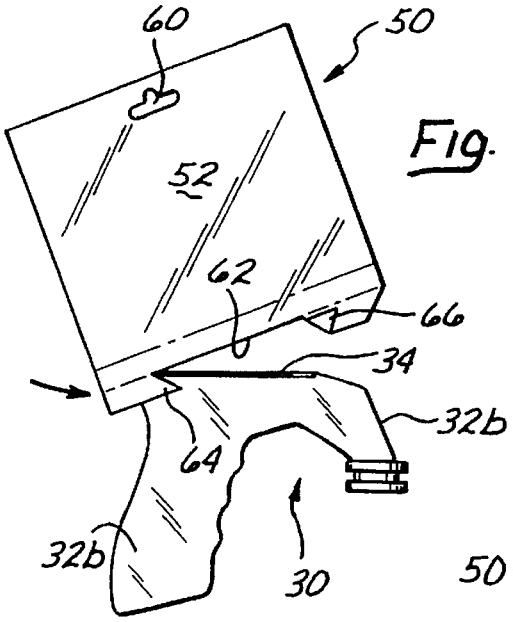
FIGS. 9, 10, and 11 are elevational views showing the steps employed in attaching a display card, in accordance with the modified first embodiment of FIG. 6, to a "butterfly" molded item.
Figure 10:
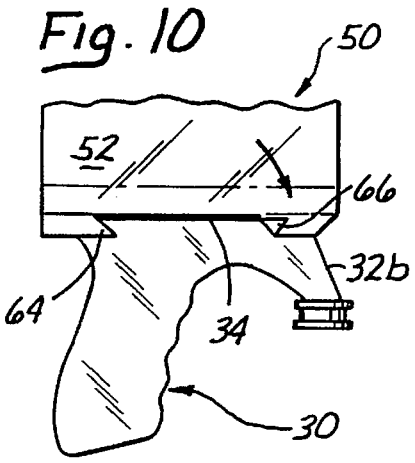
Figure 11:
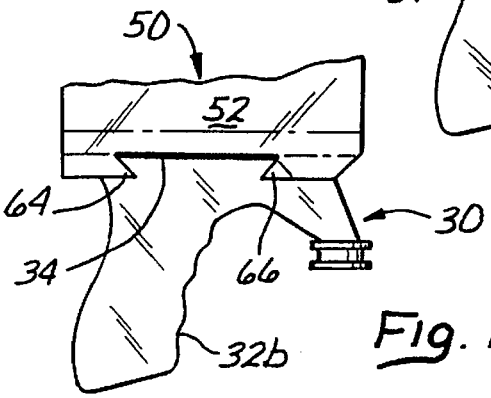

FIGS. 9, 10, and 11 illustrate the steps employed in attaching the card 50 to the butterfly-molded item 30. For the purpose of clarity, only the item half 32*b* is shown in these figures.

As shown in FIG. 9, with the item 30 in its spread or opened configuration, and with the foldable attachment finger 66 of the card in its folded position (as shown in FIG. 8), the fixed attachment finger 64 of the card 50 is inserted under the integral hinge 34. The card 50 is then pivoted downwardly on the fixed finger 64, as shown in FIG. 10, until the edge of the item 30 that includes the hinge 34 is seated in the card notch 62. Then, as shown in FIG. 11, the foldable finger 66 is unfolded to its extended position (as shown in FIG. 7) under the integral hinge 34. The short vertical edge 76 between the angled edge 74 of the foldable finger 66 and the first horizontal linear crease 70 provides sufficient clearance for the foldable finger 66 to be extended under the hinge 34 without abrading against the hinge. Finally, as described above with reference to FIG. 5, the item halves 32*a*, 32*b* are folded together to capture the fingers 64, 66 between them, thereby securing the card 50 to the item 30. Once the card 50 is secured to the item 30, the card 50 can be folded and packed as described above with reference to FIGS. 3 and 4.

Figure 12:
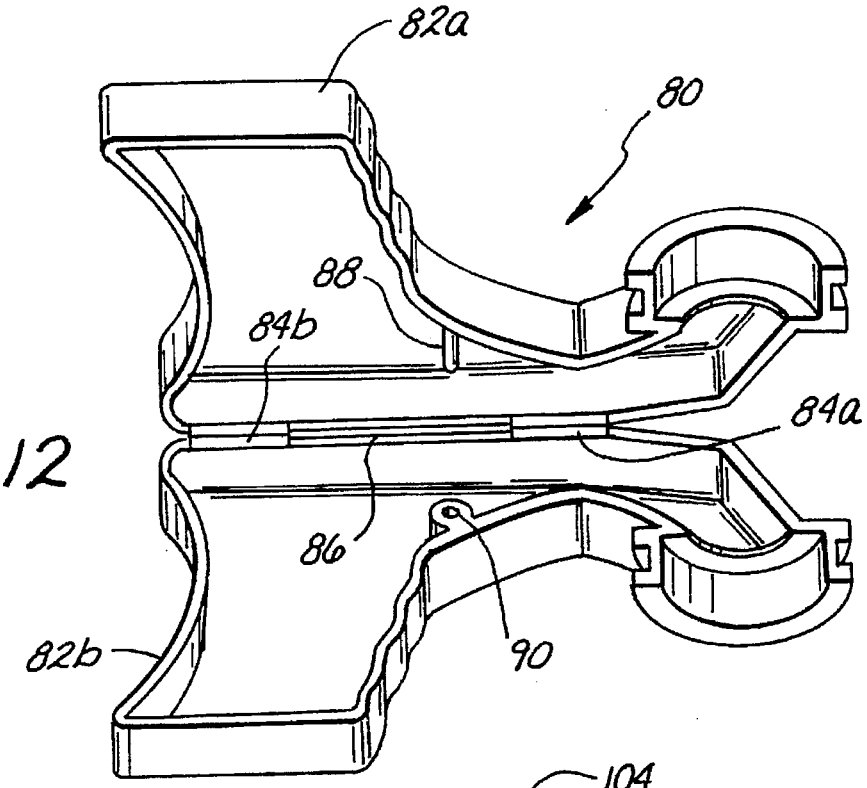
FIG. 12 is a perspective view of another type of butterfly-molded item, showing the post and socket structure used in conjunction with a second embodiment of the present invention.

FIG. 12 illustrates a modified form of a butterfly-molded device 80, comprising item halves 82*a*, 82*b*, that differs from the previously-described item 30 in two significant ways. First, the item 80 includes an integral hinge that is bifurcated into a first (front) portion 84*a* and a second (rear) portion 84*b*, separated by a linear slot 86, the hinge portions 84*a*, 84*b* and the slot 86 defining a collinear hinge axis. Second, the item 80 includes a post and socket mechanism for securing the item halves 82*a*, 82*b* together in a closed position. The post and socket mechanism comprises a post 88 extending from the interior surface of one item half 82*a*, and a socket 90 in the interior of the other item half 82*b*, sized, positioned, and oriented so as to receive the post 88.

Figure 13:
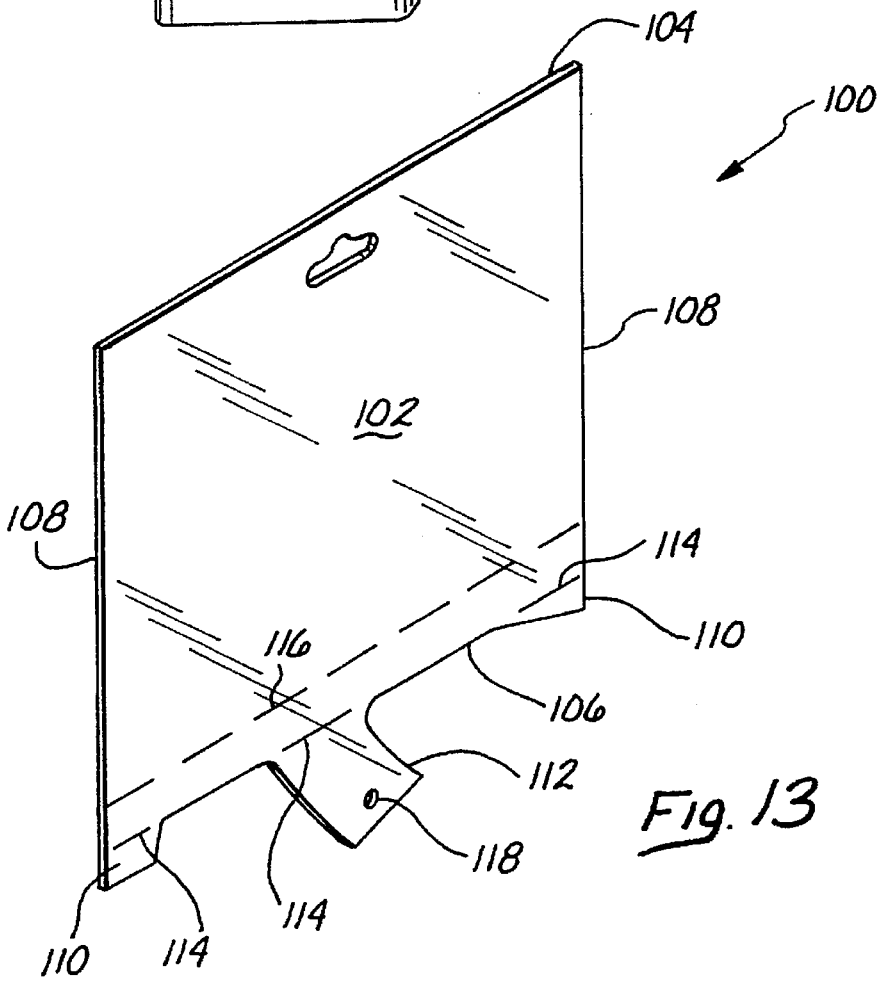
FIG. 13 is a perspective view of a foldable display card in accordance with a second embodiment of the present invention.

The modified item 80 requires another form of foldable display card. FIG. 13 discloses a foldable display card 100, in accordance with a second embodiment of the invention, that can be used with the modified item 80 of FIG. 12.

The card 100 comprises a flat piece of cardboard, having a front surface 102 defined between a top edge 104, a bottom edge 106, and a pair of opposed side edges 108. It may be desired to provide a pair of downwardly extending extensions 110 from the bottom edge 106, at the juncture between the bottom edge 106 and each side edge 108, to conform the bottom edge 106 more closely to the adjacent upper portion of the item 80.

The attachment means in this embodiment comprises a projection 112 contiguous with and extending downwardly from the bottom edge 106 of the card 50. A first linear horizontal crease 114 extends along the juncture between the projection 112 and the bottom edge 106, and along the junctures between the downward extensions 110 and the bottom edge 106. A second linear horizontal crease 116 is spaced above, and extends parallel to, the first crease 114 The creases 114, 116 perform the same function as previously described, functioning as hinge means to allow the card 100 to be folded over the item 80 in the manner described above and illustrated in FIG. 3.

Figure 14:
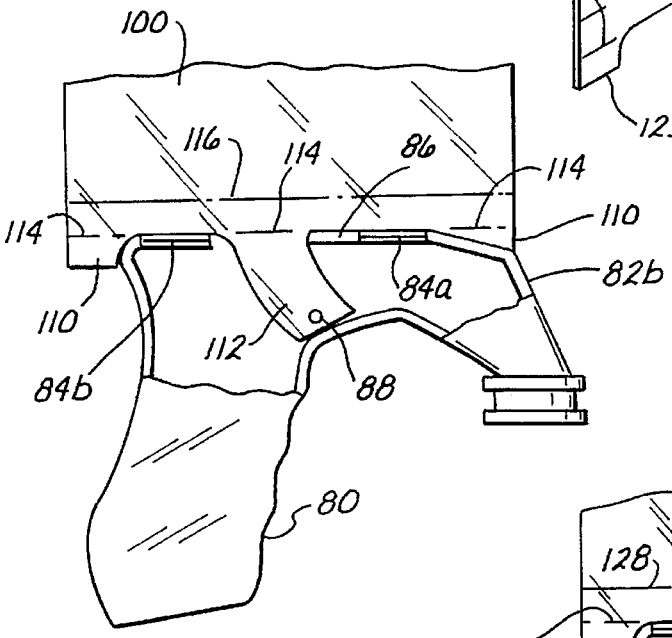
FIG. 14 is an elevational view, partially broken away, showing the attachment of the display card of FIG. 12 to the item of FIG. 13.

As shown in FIG. 14, the projection 112 extends through the slot 86 between the integral hinge portions 84*a*, 84*b* of the item 80. An aperture 118 in the projection 112 receives the post 88 attached to the one item half 82*a*, with the post 88, in turn, being received in a socket 90 in the other item half 82*b* when the two item halves are folded together.

Figure 15:
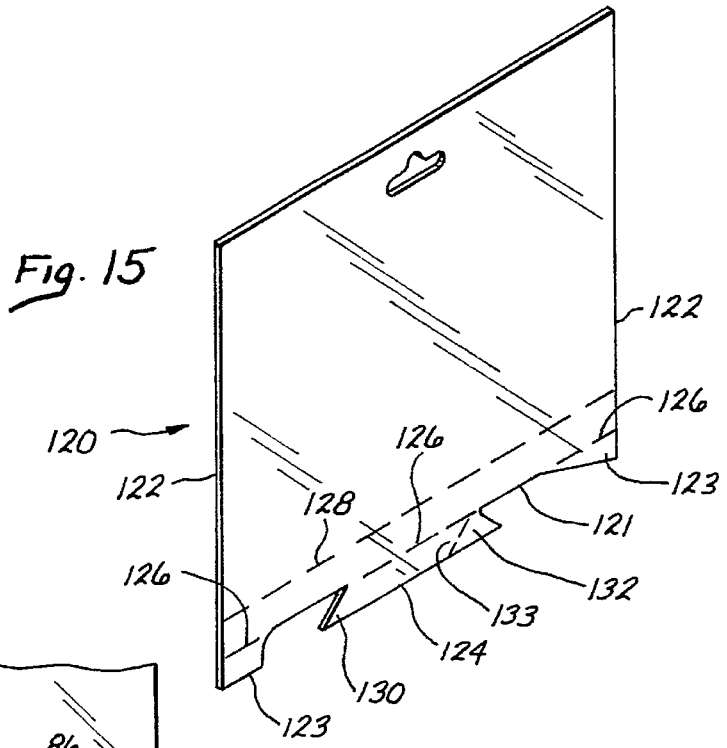
FIG. 15 is a perspective view of a foldable display card in accordance with a third embodiment of the present invention.
Figure 16:
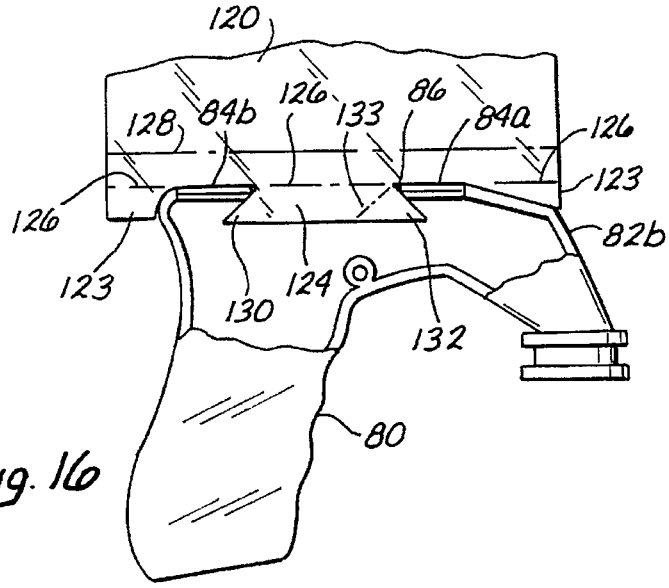
FIG. 16 is an elevational view, partially broken away, showing the display card of FIG. 15 attached to a modified form of the butterfly-molded item.

FIGS. 15 and 16 illustrate a foldable display card 120 in accordance with a third embodiment of the invention. This third embodiment is, like the above-described second embodiment, adapted for use with the "split-hinge" item 80, but, unlike the second embodiment, this third embodiment does not require or utilize the post and socket structure that may be present in the item 80.

In this third embodiment, the card 120 has a bottom edge 121, a pair of side edges 122, and, preferably, a pair of downwardly-directed extensions 123 at opposite ends of the bottom edge 121, as described above in connection with the second embodiment. In this embodiment, the attachment means comprises a shallow, substantially trapezoidal projection 124 along the bottom edge 121, and contiguous therewith. A first linear horizontal crease 126 extends along the juncture between the trapezoidal projection 124 and the bottom edge 121, with a second linear horizontal crease 128 spaced upwardly from, and parallel to, the first crease 126. The creases 126, 128 provide the same hinging function previously described.

The opposite sides of the trapezoidal projection define a pair of opposed, laterally outwardly-pointed fingers 130, 132, the former being fixed, and the latter preferably having a hinge 133 so as to be foldable back over the projection 124 toward the fixed finger 130. When the item 80 is unfolded, and while the foldable finger 132 is folded over the projection 124, the fixed finger 130 is inserted under one portion of the integral hinge of the item 80, and the projection 124 is inserted into the gap 86 between the hinge portions 84*a*, 84*b*. The foldable finger 132 is then unfolded to extend under the other portion of the integral hinge. Finally, the item halves 82*a*, 82*b* are folded together, capturing the projection 124 between them.

Figure 17:
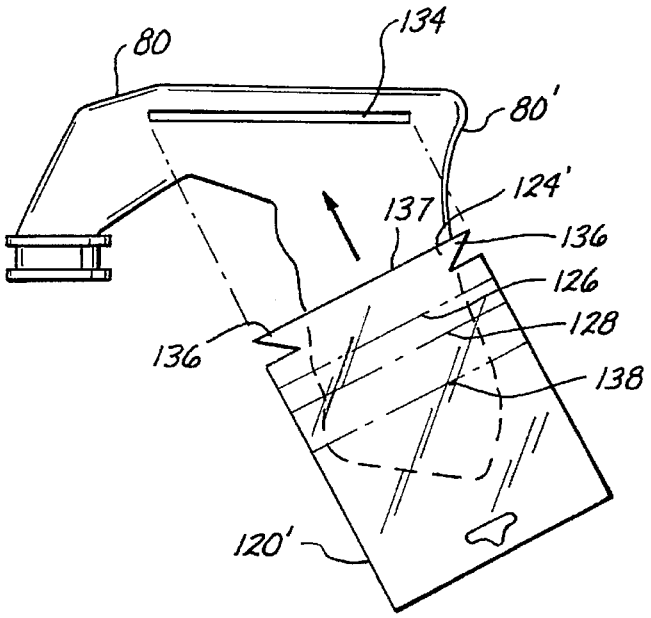
FIG. 17 is a side elevational view showing a modified form of the display card of FIG. 15 being attached to another modified form of the butterfly-molded item.
Figure 18:
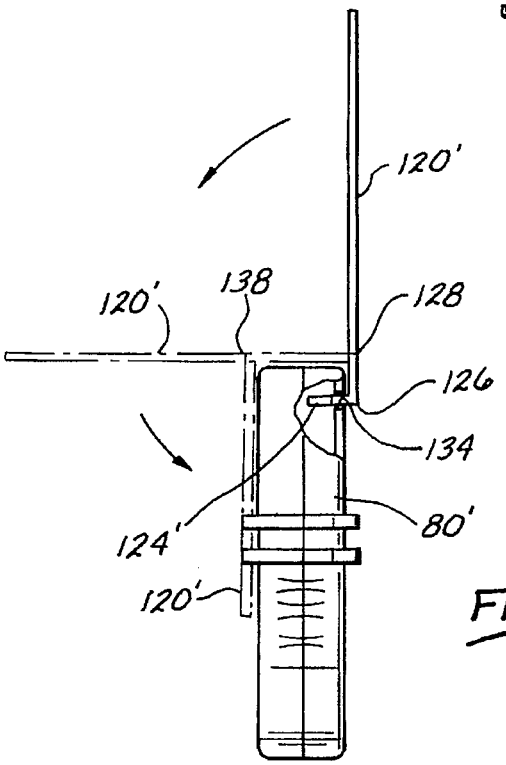
FIG. 18 is an end elevational view taken from the front end of the butterfly-molded item of FIG. 17, showing the display card of FIG. 17 attached to the item and showing the steps in folding the display card about the item.

In a variation of this third embodiment, a modified card 120', shown in FIGS. 17 and 18, is employed with an item 80' having a horizontal slot 134 provided in the side of one of the item halves. The side slot 134 is aligned with, and substantially parallel to, the axis defined by the integral hinge (which may be of either the unitary type or the bifurcated type described above). The modified card 120' has a trapezoidal projection 124' that is inserted into the slot 134. The trapezoidal configuration of the projection 124' defines two opposed fixed fingers 136. The projection 124' has a long edge 137 that advantageously is slightly longer than the slot 134, and, preferably, nearly as long as the bottom edge 121 of the card 120' (thereby eliminating the downwardly-directed extensions 123 on opposite sides of the bottom edge 121, as described above).

Attachment of the card 120' to the item 80' is performed by inserting one finger 136 of the projection 124' into the slot 134 and then sliding the inserted finger past the end of the slot 134 in the interior of the item 80' until the other finger 136 can be inserted into the slot 134. The card 120' is then centered in the slot 134 to allow both fingers 136 to engage the interior surface of the item 80' adjacent the ends of the slot 134.

In this side-mounted variation, the hinge means of the card further comprises a third crease 138, parallel to and spaced upwardly from, the second crease 128. Upon insertion of the projection 124' into the side slot 134, the card 120' lies substantially perpendicular to the side of the item 80'. Referring to FIG. 18, it can be seen that the card 120' is then folded 90° along the first crease to bring it substantially parallel to the side of the item 80'. Then the card 120' is folded 90° along the second crease 128, and finally it is folded 90° along the third crease 138 to bring the card 120' into its folded configuration, wherein the card 120 overlies the item 80'.

Figure 19:
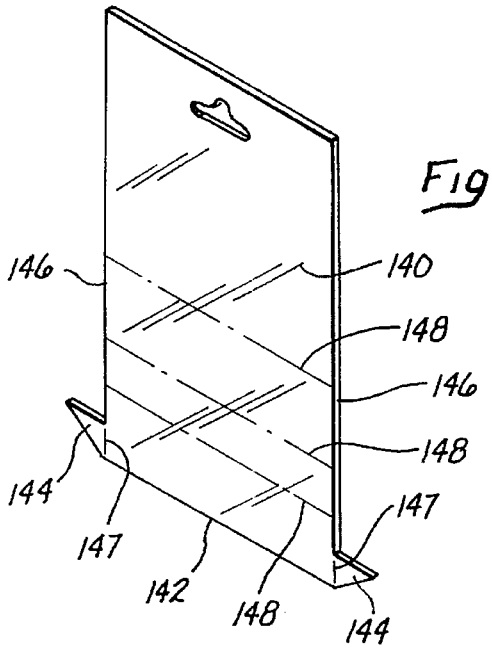
FIG. 19 is a perspective view of a foldable display card in accordance with a fourth embodiment of the invention.

FIG. 19 illustrates a fourth embodiment, comprising a foldable display card 140 that has a linear bottom edge 142, wherein the attachment means comprises a pair of substantially triangular fingers 144 projecting laterally outwardly from each lateral edge 146 of the card 140 adjacent to and contiguous with the bottom edge 142. One or both of the fingers 144 may include a hinge 147 so as to be foldable inwardly toward the opposite lateral edge 146, and the hinge means may comprise either two or three parallel horizontal creases 148, depending upon whether the card 140 is to be inserted into a slot in the top surface (two creases) or the side surface (three creases) of the item. Thus, with two creases, the card 140 is folded as shown in FIG. 3, and with three creases it is folded as shown in FIG. 18.

Figure 20:
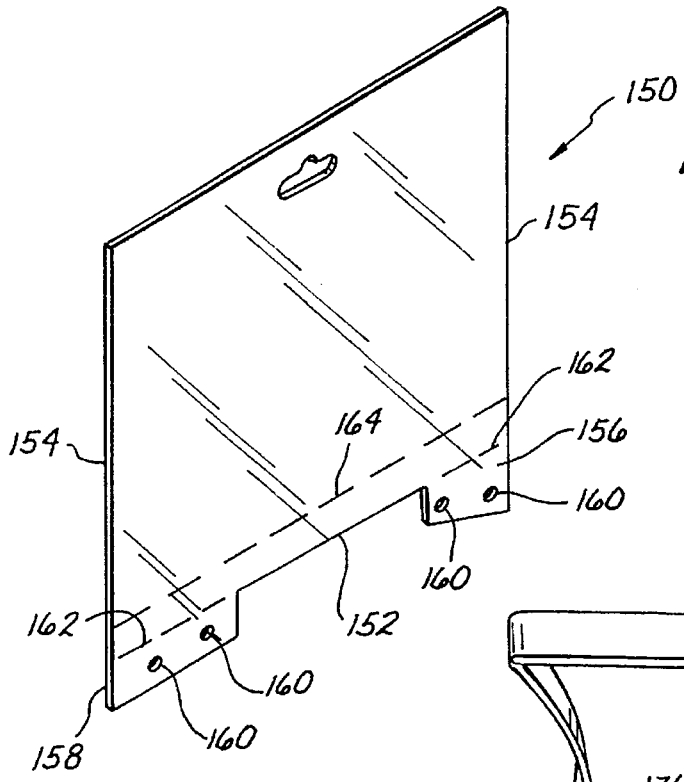
FIG. 20 is a perspective view of a foldable display card in accordance with a fifth embodiment of the invention.
Figure 21:
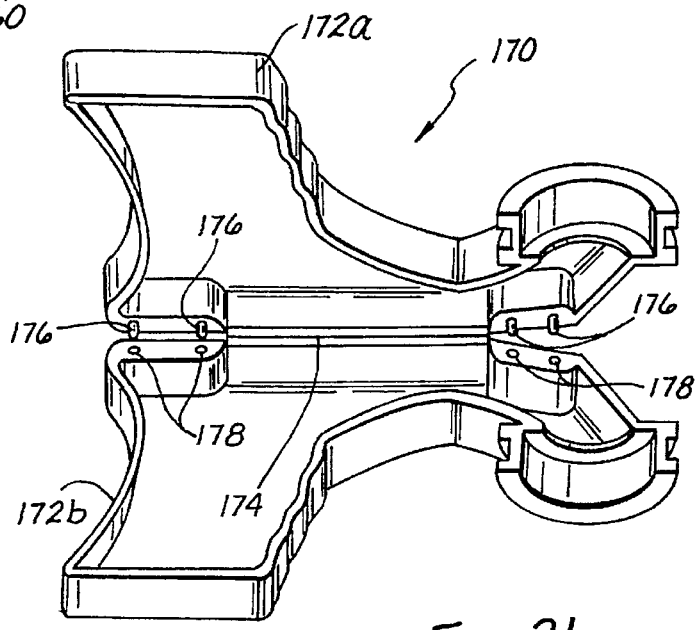
FIG. 21 is a perspective of another modified form of a butterfly-molded item, suitable for use with the foldable display card of FIG. 20, shown partially open to reveal the post and socket structure in the interior of the item.
Figure 22:
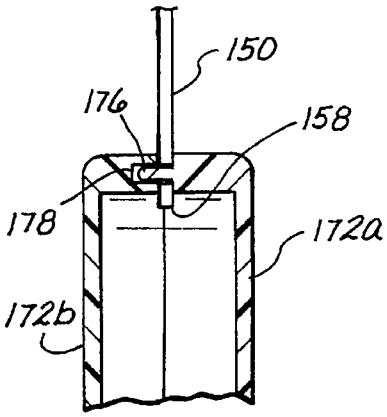
FIG. 22 is a detailed cross-sectional view of a portion of the item of FIG. 21 with the foldable display card of FIG. 21 attached to it.

FIGS. 20, 21, and 22 illustrate a foldable display card 150, in accordance with a fifth embodiment, wherein the card 150 has a bottom edge 152 and lateral edges 154. In this embodiment, the attachment means comprises a front tab 156 and a rear tab 158 contiguous with and extending downwardly from the bottom edge 152 of the card 150, adjacent each of the lateral edges 154 thereof. One or more apertures 160 are provided in each of the tabs 156, 158. The hinge means in this embodiment comprises a first linear horizontal crease 162 lying along the juncture between each of the tabs 156, 158 and the bottom edge 152 of the card 150, and a second linear horizontal crease 164 spaced upwardly from, and parallel to the first crease 162.

The card 150 is designed for use with another modified form of butterfly-molded item 170, shown in FIGS. 21 and 22. The item 170 comprises first and second item halves **172*a*, 172*b*, respectively, joined at an integral "living" hinge 174 along the upper edge of the item 170. The item 170 includes a post and socket structure, comprising a plurality of posts 176 extending from the interior surface of the first item half 172*a*, and a plurality of sockets 178 on the interior surface of the second item half 172*b*. Each of the sockets 178 is dimensioned, located, and oriented to receive one of the posts 176 to secure the item halves 172*a*, 172*b*** to each other when they are folded together.

To secure the item 170 to the card 150, the hinged edge of the 170 item fits between the tabs 156, 158, with the tabs 156, 158 extending between the item halves **172*a*, 172*b* on opposite sides of the integral hinge 174. As shown in FIG. 22, when the tabs 156, 158 are thus located, each of the apertures 160 receives one of the posts 176. Each of the posts 176, in turn, is received in a corresponding socket 178 when the item halves 172*a*, 172*b* are folded together with the tabs 156, 158 between them, on either side of the integral hinge 174. When the item 170 is thus attached to the card 150, the card 150 can then be folded over the item 170 in the manner shown in FIG. 3, using the creases 162, 164** as previously described.

From the foregoing description, it can be seen that the present invention offers the advantage of significant space savings during shipping and storage, as compared with conventional display cards, without compromising the primary function of displaying information about the product to which it is attached. In addition, a display card in accordance with the present invention includes means, integral with the card itself, for self-attaching the card to the item to be displayed, without the need for additional, separate attachment devices or structures. Moreover, display cards in accordance with the present invention can be made easily and inexpensively, by simply altering the current conventional manufacturing process to include the steps of creating the creases and forming the attachment means.

It will be appreciated that a number of variations and modifications of the above-described embodiments will suggest themselves to those skilled in the pertinent arts. For example, as mentioned above, the card can be formed in a variety of shapes and sizes, to suit different needs and applications. Likewise, the card aperture can be made in different shapes and sizes, or it can be omitted altogether, as noted above. Similarly, the attachment means for removably attaching the card to the item may be assume a wide variety of forms to suit a similar variety of items. These and other variations and modifications that may suggest themselves should be considered within the spirit and scope of the present invention, as defined in the claims that follow.

What is claimed is:

1. A display card that is attachable to a butterfly-molded item, the item having an integral hinge joining a pair of item halves, each of the item halves defining an interior surface, the item halves being foldable together along the hinge, the display card comprising:

a flat surface defining a top edge, first and second opposed side edges, and a bottom edge;

hinge means, formed in the card near the bottom edge thereof, for allowing the card, when attached to the item, to be selectively folded from an unfolded configuration into a folded configuration in which a substantial portion of the flat surface overlies the item;

an extended portion of the card that is contiguous with the bottom edge of the card; and means on the extended portion for engaging a portion of at least one of the item halves on the interior surface thereof.

2. The display card of claim 1, wherein the hinge means comprises:

a first substantially linear horizontal crease formed in the card proximate the juncture between the extended portion and the bottom edge; and a second substantially linear horizontal crease formed in the card near and substantially parallel to the first crease.

3. The display card of claim 1, wherein at least one of the item halves includes a post extending from the interior surface, wherein the extended portion includes a projection extending downwardly from the bottom edge, and wherein the means on the extended portion includes a hole in the projection that is located and dimensioned to receive the post when the item halves are folded together.

4. The display card of claim 3, wherein the integral hinge of the item includes first and second hinge portions with a substantially collinear slot therebetween, and wherein the projection is located and dimensioned to extend into the slot.

5. The display card of claim 3, wherein at least one of the item halves includes a plurality of posts extending from the interior surface thereof, and wherein the extended portion includes a first projection adjacent the first side edge and a second projection adjacent the second side edge, each of the first and second projections being disposed and oriented so as to be capable of being captured between the item halves when the item halves are folded together, each of the projections having a hole that is located and dimensioned to receive one of the posts when the item halves are folded together.

6. The display card of claim 1, wherein the item includes a slot that is collinear with or parallel to the integral hinge, and wherein the extended portion is located and dimensioned so as to be inserted into the slot.

7. The display card of claim 6, wherein the extended portion includes a substantially trapezoidal projection that extends downwardly from the bottom edge and that defines a pair of opposed fingers, and wherein the means on the extended portion includes the pair of opposed fingers.

8. The display card of claim 7, wherein at least one of the fingers is hinged so as to be foldable over the extended portion toward the other finger.

9. The display card of claim 7, wherein the hinge means comprises:

a first substantially horizontal crease formed in the card proximate the juncture between the extended portion and the bottom edge;

a second substantially linear horizontal crease formed in the card substantially parallel to the first crease; and a third substantially linear horizontal crease formed in the card substantially parallel to the second crease.

10. The display card of claim 1, wherein the extended portion includes a finger extending laterally outwardly from each of the side edges adjacent to the bottom edge.

11. The display card of claim 10, wherein at least one of the fingers includes a hinge so as to be foldable laterally inwardly toward the other finger.

12. The display card of claim 10, wherein the hinge means comprises:

a first substantially horizontal linear crease formed in the card substantially parallel to the bottom edge; and a second substantially horizontal linear crease formed in the card substantially parallel to the first crease.

13. The display card of claim 12, wherein the hinge means further comprises;

a third substantially horizontal linear crease formed in the card substantially parallel to the second crease.

14. A display card that is attachable to a butterfly-molded item, the item having a slot collinear with or parallel to an integral hinge joining a pair of item halves, each of the item halves defining an interior surface, the item halves being foldable together along the hinge, the display card comprising:

a flat surface defining a top edge, first and second opposed side edges, and a bottom edge;

hinge means, formed in the card near the bottom edge thereof, for allowing the card, when attached to the item, to be selectively folded from an unfolded configuration into a folded configuration in which a substantial portion of the flat surface overlies the item;

an extended portion of the card that is contiguous with the bottom edge of the card and disposed so as to be insertable into the slot; and means on the extended portion for engaging a portion of at least one of the item halves on the interior surface thereof when the extended portion is inserted into the slot.

15. The display card of claim 14, wherein the hinge means comprises:

a first substantially linear horizontal crease formed in the card proximate the juncture between the extended portion and the bottom edge; and a second substantially linear horizontal crease formed in the card near and substantially parallel to the first crease.

16. The display card of claims 14 or 15, wherein the integral hinge of the item includes first and second hinge portions with the slot disposed therebetween, wherein at least one of the item halves includes a post extending from the interior surface, wherein the extended portion includes a projection extending downwardly from the bottom edge, and wherein the means on the extended portion includes a hole in the projection that is located and dimensioned to receive the post when the item halves are folded together with the projection disposed within the slot.

17. The display card of claims 14 or 15, wherein the extended portion includes a substantially trapezoidal projection that extends downwardly from the bottom edge and that defines a pair of opposed fingers, and wherein the means on the extended portion includes the pair of opposed fingers.

18. The display card of claim 17, wherein at least one of the fingers is hinged so as to be foldable over the extended portion toward the other finger.

19. The display card of claims 14 or 15, wherein the extended portion includes a finger extending laterally outwardly from each of the side edges adjacent to the bottom edge.

20. The display card of claim 19, wherein at least one of the fingers includes a hinge so as to be foldable laterally inwardly toward the other finger.

21. A display card that is attachable to a butterfly-molded item, the item having a linear slot defined between first and second integral hinge portions joining a pair of item halves, each of the item halves defining an interior surface, the item halves being foldable together along the hinge, at least one of the item halves having a post extending from the interior surface thereof, the display card comprising:

a flat surface defining a top edge, first and second opposed side edges, and a bottom edge;

hinge means, formed in the card near the bottom edge thereof, for allowing the card, when attached to the item, to be selectively folded from an unfolded configuration into a folded configuration in which a substantial portion of the flat surface overlies the item; and a projection extending downwardly from the bottom edge of the card and disposed so as to be insertable into the slot, the projection including a hole that is located and dimensioned so as to receive the post when the item halves are folded together with the projection disposed within the slot.

22. The display card of claim 21, wherein the hinge means comprises:

a first substantially linear horizontal crease formed in the card proximate the juncture between the extended portion and the bottom edge; and a second substantially linear horizontal crease formed in the card near and substantially parallel to the first crease.

23. A display card that is attachable to a butterfly-molded item, the item having a slot collinear with or parallel to an integral hinge joining a pair of item halves, each of the item halves defining an interior surface, the item halves being foldable together along the hinge, the display card comprising:

a flat surface defining a top edge, first and second opposed side edges, and a bottom edge;

hinge means, formed in the card near the bottom edge therefor, for allowing the card, when attached to the item, to be selectively folded from an unfolded configuration into a folded configuration in which a substantial portion of the flat surface overlies the item; and a substantially trapezoidal projection that extends downwardly from the bottom edge so as to be insertable into the slot and that defines a pair of opposed fingers that engage the interior surface when the projection is inserted into the slot.

24. The display card of claim 23, wherein at least one of the fingers is hinged so as to be foldable over the extended portion toward the other finger.

25. The display card of claims 23 or 24, wherein the hinge means comprises:

a first substantially linear horizontal crease formed in the card proximate the juncture between the extended portion and the bottom edge; and a second substantially linear horizontal crease formed in the card substantially parallel to the first crease.

26. The display card of claim 25, wherein the hinge means further comprises:

a third substantially linear horizontal crease formed in the card substantially parallel to the second crease.

27. A display card that is attachable to a butterfly-molded item, the item having a slot collinear with or parallel to an integral hinge joining a pair of item halves, each of the item halves defining an interior surface, the item halves being foldable together along the hinge, the display card comprising:

a flat surface defining a top edge, first and second opposed side edges, and a bottom edge;

hinge means, formed in the card near the bottom edge thereof, for allowing the card, when attached to the item, to be selectively folded from an unfolded configuration into a folded configuration in which a substantial portion of the flat surface overlies the item; and a finger extending laterally outwardly from each of the side edges adjacent to the bottom edge, whereby the fingers engage the interior surface when the bottom edge and the fingers are inserted into the slot.

28. The display card of claim 27, wherein at least one of the fingers is hinged so as to be foldable toward the other finger.

29. The display card of claims 27 or 28, wherein the hinge means comprises:

a first substantially linear horizontal crease formed in the card proximate the juncture between the extended portion and the bottom edge; and a second substantially linear horizontal crease formed in the card substantially parallel to the first crease.

30. The display card of claim 29, wherein the hinge means further comprises:

a third substantially linear horizontal crease formed in the card substantially parallel to the second crease.

31. A display card that is attachable to a butterfly-molded item, the item having an integral hinge joining a pair of item halves, each of the item halves defining an interior surface, one of the item halves having a plurality of posts extending from the interior surface thereofthe item halves being foldable together along the hinge, the display card comprising:

a flat surface defining a top edge, first and second opposed side edges, and a bottom edge;

hinge means, formed in the card near the bottom edge thereof, for allowing the card, when attached to the item, to be selectively folded from an unfolded configuration into a folded configuration in which a substantial portion of the flat surface overlies the item; and a first projection extending downwardly from and contiguous with the bottom edge adjacent the first side edge, and a second projection extending downwardly from and contiguous with the bottom edge adjacent the second side edge, each of the first and second projections being disposed and oriented so as to be capable of being captured between the item halves when the item halves are folded together, each of the projections having a hole that is located and dimensioned to receive one of the posts when the item halves are folded together.

32. The display card of claim 31, wherein the hinge means comprises:

a first substantially linear horizontal crease formed in the card proximate the juncture between the first and second projections and the bottom edge; and a second substantially linear horizontal crease formed in the card substantially parallel to the first crease.

* * * * *

UNITED STATES PATENT AND TRADEMARK OFFICE

CERTIFICATE OF CORRECTION

PATENT NO. : 5,649,621

DATED : July 22, 1997

INVENTOR(S) : Brody

It is certified that error appears in the above-indentified patent and that said Letters Patent is hereby corrected as shown below:

Column 13, line 13, "therefor" should be --thereof--.

Signed and Sealed this

Twenty-fifth Day of November, 1997

*Attest:*

*Attesting Officer*

Bruce Lehman

BRUCE LEHMAN

*Commissioner of Patents and Trademarks*